US011125238B2

(12) United States Patent
Wang et al.

(10) Patent No.: US 11,125,238 B2
(45) Date of Patent: Sep. 21, 2021

(54) AXIAL FLOW WIND WHEEL AND AIR CONDITIONER

(71) Applicants: GD MIDEA AIR-CONDITIONING EQUIPMENT CO., LTD, Foshan (CN); MIDEA GROUP CO., LTD., Foshan (CN)

(72) Inventors: Bo Wang, Foshan (CN); Xujie Cai, Foshan (CN); Hejie Zhou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 207 days.

(21) Appl. No.: 16/443,423

(22) Filed: Jun. 17, 2019

(65) Prior Publication Data

US 2019/0301471 A1 Oct. 3, 2019

Related U.S. Application Data

(63) Continuation of application No. PCT/CN2018/084878, filed on Apr. 27, 2018.

(30) Foreign Application Priority Data

Feb. 7, 2018 (CN) ..... 201810138856.3

(51) Int. Cl.
*F04D 19/00* (2006.01)
*F04D 29/32* (2006.01)
(Continued)

(52) U.S. Cl.
CPC ..... *F04D 19/002* (2013.01); *F04D 29/329* (2013.01); *F04D 29/384* (2013.01); *F24F 1/028* (2019.02)

(58) Field of Classification Search
CPC .... F04D 19/002; F04D 29/164; F04D 29/181; F04D 29/26; F04D 29/32; F04D 29/324;
(Continued)

(56) References Cited

U.S. PATENT DOCUMENTS 8,512,004 B2 * 8/2013 Nakagawa ..... F04D 29/384 416/228
8,721,280 B2 * 5/2014 Nakagawa ..... F04D 29/164 415/222

FOREIGN PATENT DOCUMENTS

CN 102022381 4/2011
CN 205639069 10/2016
(Continued)

OTHER PUBLICATIONS

Guangdong Midea Consumer Electrics Manufacturing Co. Ltd., International Search Report and Written Opinion, PCT/CN2018/084878, dated Oct. 26, 2018, 14 pgs.

*Primary Examiner* — Woody A Lee, Jr.
*Assistant Examiner* — Brian O Peters
(74) *Attorney, Agent, or Firm* — Morgan, Lewis & Bockius LLP

(57) ABSTRACT

The present disclosure provides an axial flow wind wheel and an air conditioner, the axial flow wind wheel includes a wheel hub and a plurality of blades, the blades are arranged on the wheel hub at intervals, the blade includes a front blade edge and a rear blade edge arranged from front to back, and a top blade edge connecting to outer ends of the front blade edge and the rear blade edge, the top blade edge defines a cut surface inclining from a pressure surface to a suction surface of the blade, and the cut surface extends from the front blade edge to the rear blade edge, the cut surface includes an outer cut edge defined at the top blade edge, and an inner cut edge defined at the pressure surface, and the inner cut edge is
(Continued)

defined to concave inwards and protrude outwards, forming a concave-convex shape.

18 Claims, 4 Drawing Sheets

(51) Int. Cl.
*F04D 29/38* (2006.01)
*F24F 1/028* (2019.01)

(58) Field of Classification Search
CPC ..... F04D 29/325; F04D 29/38; F04D 29/384; F05D 2240/307
See application file for complete search history.

(56) References Cited

FOREIGN PATENT DOCUMENTS

| | | |
|---|---|---|
| CN | 205654595 | 10/2016 |
| CN | 107489646 | 12/2017 |
| CN | 207879692 | 9/2018 |
| JP | 2008157117 | 7/2008 |
| WO | WO2019008390 | 1/2019 |

* cited by examiner

AXIAL FLOW WIND WHEEL AND AIR CONDITIONER

CROSS REFERENCE TO RELATED APPLICATIONS

This application is a continuation application of PCT Patent Application No. PCT/CN2018/084878, filed on Apr. 27, 2018, which claims priority to Chinese Patent Application No. 201810138856.3, filed on Feb. 7, 2018, all of which are hereby incorporated by reference in their entirety.

TECHNICAL FIELD

The present disclosure relates to the technical field of air conditioners, and more particularly relates to an axial flow wind wheel and an air conditioner.

BACKGROUND

Axial flow wind wheels are commonly used in household appliances or air conditioners as air ventilation devices. Air around the axial flow wind wheel is driven by the axial flow wind wheel to rotate and form an airflow, to blow out along the axial direction of the axial flow wind wheel. With an increasing rotating speed of the axial flow wind wheel, the noise generated by the axial flow wind wheel also increases. And, during rotating of the blade, the rotational speed of the blade tip is maximized, and the pressure surface of the blade is relatively smooth, so that it is prone to form leakage vortex at the blade tip from the suction surface of the blade to the pressure surface, resulting in a large vortex noise.

SUMMARY

It is therefore one main object of the present disclosure to provide an axial flow wind wheel, which aims to reduce the leakage vortex generated at the blade tip position of the axial flow wind wheel, to reduce the vortex and the noise.

To achieve the above object, the present disclosure provides an axial flow wind wheel and an air conditioner using the axial flow wind wheel. The axial flow wind wheel includes a wheel hub and a plurality of blades. The blades are arranged on the wheel hub at intervals, the blade includes a front leaf margin and a rear leaf margin arranged from front to back, and a top leaf margin connecting to outer edges of the front leaf margin and the rear leaf margin, the top leaf margin defines a section inclined from a pressure surface of the blade to a suction surface of the blade, and extended from the front leaf margin to the rear leaf margin, the section includes an external edge and an inner edge respectively defined at the inner side and the outer side, and the inner edge is defined to be concave and convex inwards and outwards.

Preferably, the inner edge includes convex portions protruding outwards, and a distance between a first connecting line connecting the top ends of each convex portion of the inner edge and the external edge is recorded as D1, D1∈[1 millimeter, 10 millimeters]; and, a concave portion concaving inwards is defined between any two adjacent convex portions, and a distance between a second connecting line connecting the bottom ends of each concave portion of the inner edge and the first connecting line is recorded as D2, and D2∈ [2 millimeters, 15 millimeters].

Preferably, the distance between the first connecting line and the external edge gradually increases from front to back.

Preferably, the distance between the second connecting line and the first connecting line gradually increases from front to back.

Preferably, the distance between any one of the convex portions and a previous adjacent convex portion is recorded as $S_1$, and the distance between the any one of the convex portions and a subsequent adjacent convex portion is recorded as $S_2$, $S_2 \in [1.2S_1, 1.5S_1]$.

Preferably, a tangential angle formed between the section and an extending surface of the pressure surface is recorded as $\alpha$, $\alpha \in$ [10 degrees, 20 degrees].

Preferably, $\alpha$ is configured to gradually increase from front to back.

Preferably, the section defines a guide groove extending from the front leaf margin to the rear leaf margin, and the guide groove has a width of 0.5 millimeters to 3 millimeters.

Preferably, the inner edge is defined with a jagged shape or a corrugated shape.

According to the technical solutions of the present disclosure, the top leaf margin of the blade defines the section inclining from the pressure surface of the blade to the suction surface of the blade, and extending from the front leaf margin to the rear leaf margin, and the inner edge of the section is defined to be concave and convex inwards and outward, so that when the axial flow wind wheel works, the airflow passing through the tip position of the blade first flows to the section, and then flows along the inclining direction of the section. As the section is relatively narrow, the airflow hardly forms the leakage vortex on the section, that is, the airflow is gradually separated on the section. However, as the inner edge of the section is defined to be concave and convex inwards and outwards, the edge trace of the top leaf margin presents an irregular shape, so that the separations of parts of the airflow are staggered with each other to form some strands of small airflow which have different frequencies, and the mixed airflow is difficult to form leakage vortex again, thereby reducing the noise generated by the leakage vortex at the tip position of the blade.

BRIEF DESCRIPTION OF THE DRAWINGS

In order to describe the technical solutions under the present disclosure or the prior art more clearly, the drawings for illustrating the embodiments of the present disclosure or the prior art are introduced briefly below. Evidently, the accompanying drawings are for exemplary purpose only, and those skilled in the art can derive other drawings from such accompanying drawings without making any creative effort.

BRIEF DESCRIPTION OF THE DRAWINGS

Figure 1:
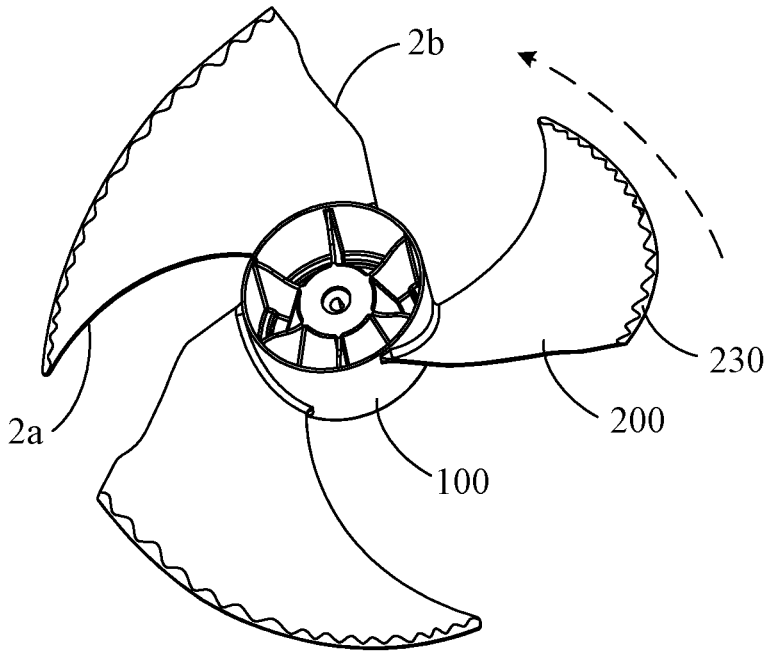
FIG. 1 is a structural diagram of an axial flow wind wheel of the present disclosure according to an embodiment.
Figure 2:
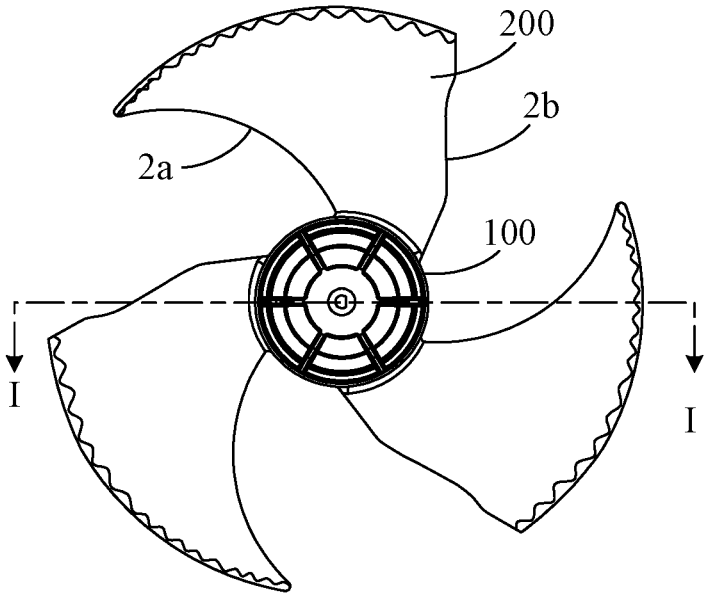
FIG. 2 is a front elevation view of the axial flow wind wheel shown in FIG. 1.

| Label | Name | Label | Name |
|---|---|---|---|
| 100 | wheel hub | 2312 | concave portion |
| 200 | blade | 232 | external edge |
| 210 | suction surface | 2a | front leaf margin |
| 220 | pressure surface | 2b | rear leaf margin |
| 230 | section | 2c | top leaf margin |
| 231 | inner edge | 10 | first connecting line |
| 2311 | convex portion | 20 | second connecting line |

The realization of the aim, functional characteristics, advantages of the present disclosure are further described specifically with reference to the accompanying drawings and embodiments.

DETAILED DESCRIPTION OF THE EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the exemplary embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the exemplary embodiment of present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides an axial flow wind wheel and an air conditioner. The axial flow wind wheel can reduce leakage vortex generated along the tip position of the blade of the axial flow wind wheel to reduce vortex and noise. In this embodiment, the axial flow wind wheel is installed in the air conditioner which can be a window type air conditioner, a split type air conditioner, or a cabinet type air conditioner. If the air conditioner is the window type air conditioner, the axial flow wind wheel is arranged at the outdoor side of the window type air conditioner; if the air conditioner is the split type air conditioner, the axial flow wind wheel is arranged at the outdoor unit of the split type air conditioner. Of course, in other embodiments, the axial flow wind wheel may also be installed in a fan, or a blower.

Figure 3:
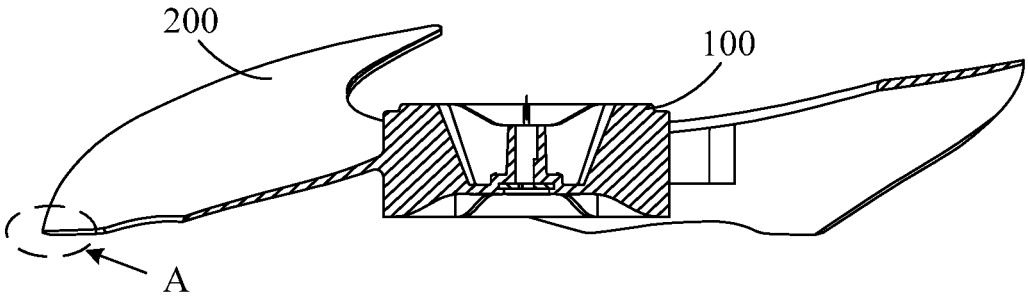
FIG. 3 is a cross sectional diagram taken along line I-I shown in FIG. 2.

Referring to FIGS. 1 and 3, in one embodiment of the axial flow wind wheel of the present disclosure, the axial flow wind wheel includes a wheel hub 100 and a plurality of blades 200. The plurality of blades 200 are arranged on the wheel hub 100 at intervals, each blade 200 includes a front leaf margin 2*a* and a rear leaf margin 2*b* arranged along the direction from front to back (the blades rotate from back to front defined by dotted arrow in FIG. 1), and a top leaf margin 2*c* (see FIGS. 3 and 4) connecting the outer edges of the front leaf margin 2*a* and the rear leaf margin 2*b*, the top leaf margin 2*c* defines a section 230 inclining from a pressure surface 220 of the blade 200 to a suction surface 210 of the blade 200. And the section 230 extends from the front leaf margin 2*a* to the rear leaf margin 2*b*. The section 230 includes an inner edge 231 defined at the inner side and an external edge 232 defined at the outer side, and the inner edge 231 is defined to be concave and convex inwards and outwards.

Specifically, the plurality of blades 200 are evenly arranged at the outer ring of the wheel hub 100 and spaced from each other, and the wheel hub 100 is configured to connect with a driving motor, such the wheel hub 100 can rotate under the action of the driving motor to bring the blades 200 to rotate, thereby guiding the air flow inside the air conditioner to the outdoor side and exhausting air to the outdoor side. As for the quantity of the blades 200, there is no specific limit, but the quantity of the blades 200 can be three to five. Specifically, in this embodiment, the quantity of blades 200 is three.

Figure 4:
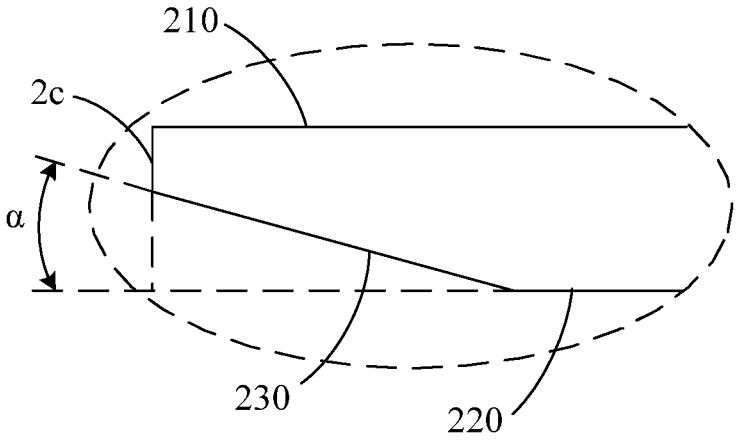
FIG. 4 is an enlarged diagram of portion A shown in FIG. 3.

Referring to FIGS. 3 and 4, the blade 200 includes the suction surface 210 facing the inlet side of the axial flow wind wheel and the pressure surface 220 facing the outlet side of the axial flow wind wheel. The section 230 is inclined from the pressure surface 220 to the suction surface 210 of the blade 200, i.e., it is equivalent to performing an angle cutting treatment at the tip position of the blade 200, and the section 230 is formed at the upper surface of the angle cutting position. Therefore, when the blades 200 rotate, the airflow passing through the tip position of the blade 200 first flows to the section 230, and flows along the inclining direction of the section 230. As the section 230 is relatively narrow, this part of the airflow hardly forms the leakage vortex on the section 230, that is, this part of the airflow is gradually separated at the inner edge 231 of the section 230. However, since the inner edge 231 of the section 230 is defined to concave and convex inwards and outwards, as such the edge trace of the top leaf margin 2*c* is irregular, so that the separations of parts of the airflow are staggered with each other, to form some strands of small airflow which have different frequencies, and it is difficult for the mixed air flow to form the leakage vortex again, thereby reducing the noise generated by the leakage vortex at the tip position of the blade.

It should be noted here that in order to achieve better noise reduction effect, the section 230 should be a smooth section 230 to reduce the noise caused by the friction between the section 230 and the airflow. There are two ways in which the inner edge 231 of the section 230 is provided in the concave-convex shape, that is, the inner edge 231 is defined with a jagged shape, or the inner edge 231 is defined with a corrugated shape. In other embodiments, the front leaf margin 2*a* may also be provided with a section 230 which extends along the front leaf margin 2*a* to reduce the resistance of the blade 200 to cross the airflow forward and also achieve the effect of reducing noise. In the following embodiments, the explanation will be given by taking the inner edge 231 with the corrugated shape as an example.

According to the technical solutions of the present disclosure, the top leaf margin 2*c* of the blade 200 defines the section 230 inclining from the pressure surface 220 of the blade 200 to the suction surface 210 of the blade 200, and the section 230 extends from the front leaf margin 2*a* to the rear leaf margin 2*b*, and the inner edge 231 of the section 230 is defined to be concave and convex inwards and outwards, so that when the axial flow wind wheel works, the airflow passing through the tip position of the blade 200 first flows to the section 230, and then flows along the inclining direction of the section 230, because the section 230 is relatively narrow, the airflow hardly forms the leakage vortex on the section 230, that is, the airflow is gradually separated on the section 230. However, as the inner edge 231 of the section 230 is defined to concave and convex inwards and outwards, the edge trace of the top leaf margin 2*c* presents an irregular shape, so that the separations of parts of the airflow are staggered with each other to form some strands of small airflow which have different frequencies, and the mixed airflow is difficult to form leakage vortex again, thereby reducing the noise generated by the leakage vortex at the tip position of the blade.

In order to verify the technical effect achieved by the axial flow wind wheel of the present disclosure, the conventional axial flow wind wheel and the axial flow wind wheel of the present disclosure were tested respectively under the same number of blades 200 and working conditions, and the measured data are as follows:

Table 1 shows measured parameters of the conventional axial flow wind wheel:

| Speed (rpm) | Air volume ($m^3$/h) | Power (W) | Noise (dB) |
|---|---|---|---|
| 850 | 3894 | 154.4 | 58.0 |
| 800 | 3713 | 143.7 | 56.4 |
| 750 | 3441 | 133.7 | 54.0 |
| 700 | 3207 | 126.4 | 51.9 |
| 650 | 2866 | 115.2 | 48.3 |

Table 2 shows measured parameters of the axial flow wind wheel of the present disclosure:

| Speed (rpm) | Air volume ($m^3$/h) | Power (W) | Noise (dB) |
|---|---|---|---|
| 850 | 3900 | 154.5 | 55.9 |
| 800 | 3717 | 143.7 | 54.6 |
| 750 | 3449 | 133.5 | 52.0 |
| 700 | 3214 | 126.3 | 50.0 |
| 650 | 2872 | 115.2 | 46.5 |

Figure 7:
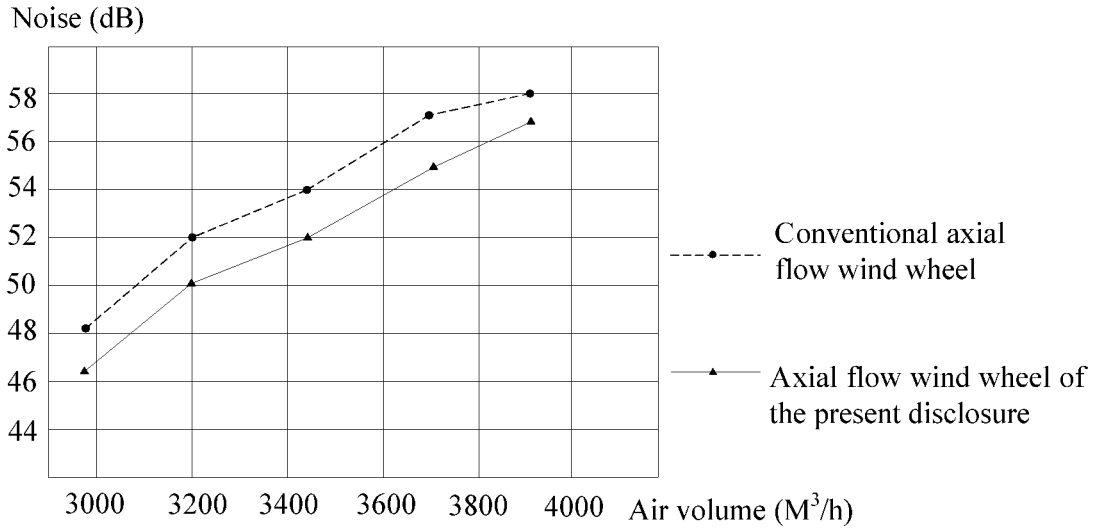
FIG. 7 is a comparison test chart of air volume and noise of the axial flow wind wheel of the present disclosure.

According to the data shown in the above tables 1 and 2, a comparison test chart of air volume and noise as shown in FIG. 7 can be drawn. According to the analysis it can be obtained that, compared with the conventional axial flow wind wheel, the axial flow wind wheel of the present disclosure has a noise reduction of 2.11 dB when the rotating speed is 850 rpm; when the speed is 800 rpm, the noise is reduced by 1.8 dB; when the speed is 750 rpm, the noise is reduced by 2.0 dB; when the speed is 700 rpm, the noise is reduced by 1.9 dB; when the speed is 650 rpm, the noise is reduced by 1.8 dB.

It can thus be seen that under the condition of the same rotating speed, the air volume of the axial flow wind wheel of the present disclosure is approximately equal to that of the conventional axial flow wind wheel, but the noise of the axial flow wind wheel of the present disclosure is significantly reduced by nearly 2 dB.

Referring to FIGS. 3 and 4, in this embodiment, it is considered that since the section 230 inclines from the pressure surface of the blade 200 to the suction surface of the blade 200, a cut angle is formed between the section 230 and the extension direction of the pressure surface of the blade 200, and the size of the cut angle directly affects the degree of inclination of the section 200. If the cut angle is too small, the degree of inclination of the section 230 is too small, and the airflow may flow from the suction surface to the pressure surface through the section, and form a small leakage vortex in the process, causing that the noise reduction effect is not obvious. If the cut angle is too large, the degree of inclination of the section 230 is too large, which tends to reduce the flow guiding force of the blade 200 and reduce the air volume. Therefore, it is preferable that the tangential angle formed by the section 230 and the extending direction of the pressure surface is recorded as $\alpha$, $\alpha \in$ [10 degrees, 20 degrees]. For example, $\alpha$ may be 12 degrees, 14 degrees, 16 degrees, 18 degrees, etc.

In order to verify the technical effect of $\alpha \in$ [10 degrees, 20 degrees] on the axial flow wind wheel of the present disclosure, the axial flow wind wheel are further tested on the basis of the above test experiment under the condition of a rotating speed of 750 r/min, and the test data are as follows:

Table 3-1 shows measured parameters of the axial flow wind wheel of the present disclosure:

| $\alpha$ | Air volume ($m^3$/h) | Power (W) | Noise (dB) |
|---|---|---|---|
| 5° | 3445 | 133.4 | 53.2 |
| 10° | 3462 | 133.5 | 52.3 |
| 15° | 3475 | 133.7 | 51.9 |
| 20° | 3466 | 133.6 | 52.1 |
| 25° | 3412 | 133.2 | 53.3 |

From the above tables 1 and 3-1, it can be seen that when $\alpha$ of the axial flow wind wheel of the present disclosure is kept within the range of 10 degrees to 20 degrees at the speed of 750 r/min, the axial flow wind wheel of the present disclosure can obtain a larger air volume than the conventional axial flow wind wheel, while the noise is significantly reduced by approximately 1.7 dB to 2.1 dB; especially when $\alpha$ is 15 degrees, the air volume obtained by the axial flow wind wheel of the present disclosure at 15 degrees reaches the maximum, and the noise reduction is the most obvious, reaching 2.1 dB. However, when $\alpha$ is reduced from 10 degrees to 5 degrees, the air volume and noise of the axial flow wind wheel are basically at the same level as these of the conventional axial flow wind wheel, and the noise reduction effect is not obvious. When $\alpha$ is reduced from 20 degrees to 25 degrees, although the noise is reduced, its air volume is also reduced by nearly 50 $m^3$/h. From the above analysis, it can be seen that a should be kept within a certain range (10 degrees to 20 degrees) in order to ensure that the axial flow wind wheel can obtain a large air volume while significantly reduce noise.

Please continue to refer to FIGS. 3 and 4. Furthermore, $\alpha$ is configured to gradually increase from front to back, for example, $\alpha$ is gradually increased from 10 degrees to 15 degrees, or is gradually increased from 12 degrees to approximately 18 degrees, or is gradually increased from 10 degrees to 20 degrees, from the front to back direction. This arrangement can effectively improve the flow guiding force of the top leaf margin 2*c* of the blade 200, reduce the generation of leakage vortex on the tip position of the blade, and achieve the effects of reducing wind loss and noise.

Obviously, the setting of α is not limited to this, and in other embodiments, α may be equal everywhere along the front to back direction, for example, 12 degrees, or 15 degrees, or 18 degrees, etc.

Figure 5:
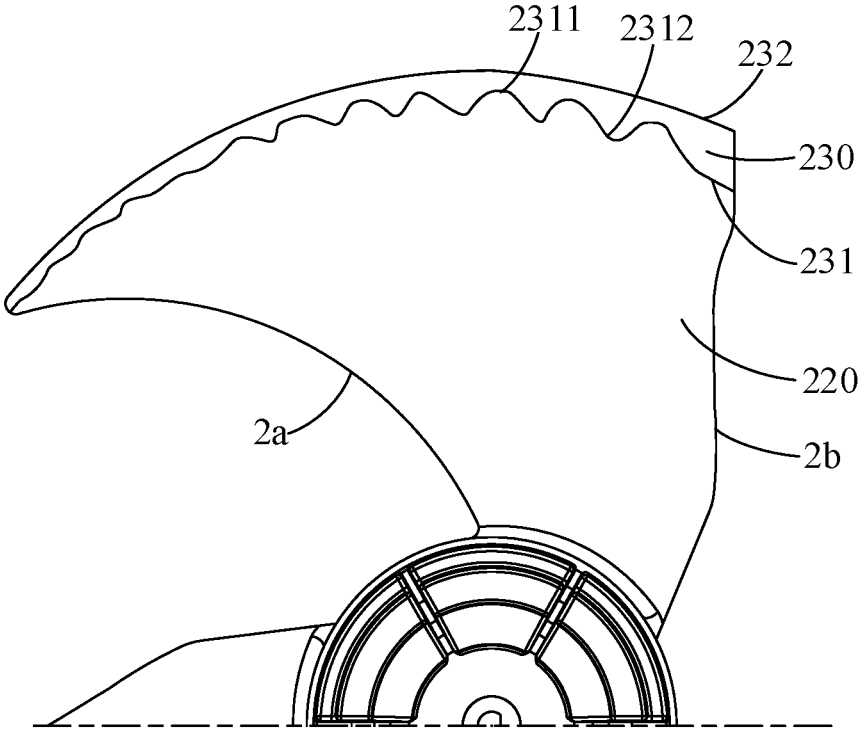
FIG. 5 is a structural diagram of a part of the axial flow wind wheel shown in FIG. 2.
Figure 6:
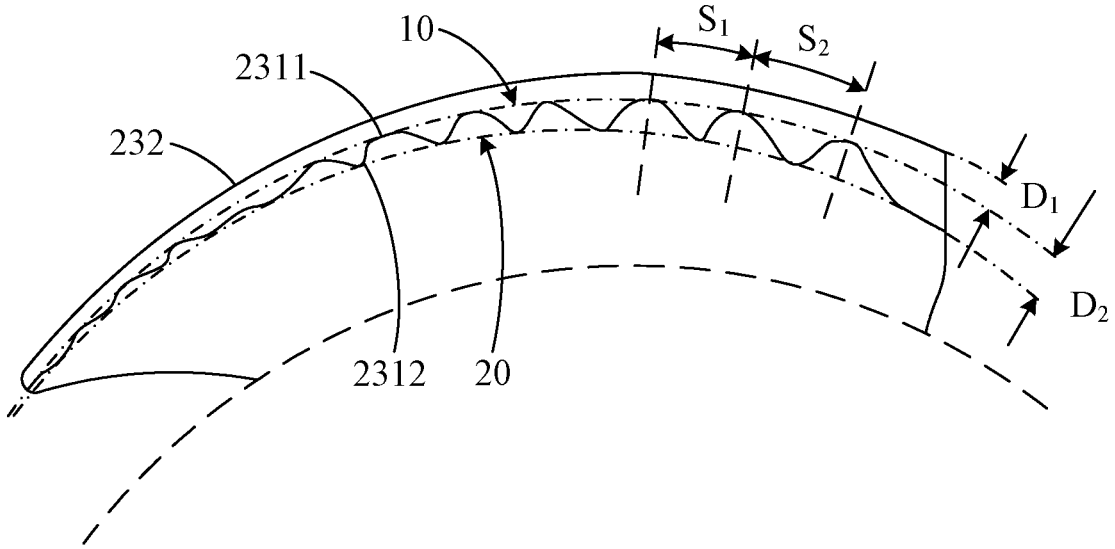
FIG. 6 is a structural diagram of the tip position of the blade shown in FIG. 2.

Referring to FIGS. 5 and 6, in this embodiment, the inner edge 231 defines convex portions 2311 protruding outward to enhance the noise reduction effect achieved by the section 230, and a distance between a first connecting line 10 connecting the top ends of each convex portion 2311 of the inner edge 231 and the external edge 232 is recorded as D1, D1∈ [1 millimeter, 10 millimeters], such as 2 millimeters, 4 mm millimeters, 6 millimeters, or 8 millimeters. It should be noted here that in this embodiment and the following embodiments, the numerical dimensions of the defined technical features are the dimensions obtained by the projection of the axial flow wind wheel on the horizontal plane when the axial flow wind wheel is placed horizontally. In addition, the first connecting line 10 is a virtual line and is only used to define the forming position of the convex portions 2311, and is not an actual structure.

Specifically, the distance D1 from any position on the first connecting line 10 to the external edge 232 may be constant or may be gradually increased from front to back. The distance D1 generally defines the forming position of the section 230. If the distance D1 is too small, the section 230 is too narrow, and the airflow may flow from the suction surface 210 to the pressure surface 220 through the section 230, and a small leakage vortex may be formed in the process, and the noise reduction effect is not obvious. Therefore, D1∈ [1 millimeter, 10 millimeters] is defined to ensure that the section 230 has a better shape.

Please continue to refer to FIGS. 5 and 6, considering that during the rotating process of the blade 200 of the axial flow wind wheel, the airflow flows along the top leaf margin 2*c* of the blade 200 from front to back, it is preferable that the distance between the first connecting line 10 and the external edge 232 is gradually increased from front to back, i.e., the distance D1 is gradually increased from front to back. For example, the D1 may gradually increase from 1 millimeter to 6 millimeters, or from 3 millimeters to approximately 8 millimeters, or from 5 millimeters to 10 millimeters, along the front to back direction. With this arrangement, the wake of section 230 can be improved, the airflow separation positions of the wake of section 230 can be effectively prolonged, and the airflow noise of the wake can be reduced.

Referring also to FIGS. 5 and 6, according to the above embodiments, a concave portion 2312 conceiving inwards is formed between any two adjacent convex portions 2311, and a distance between a second connecting line 20 connecting the bottom ends of each concave portion 2312 of the inner edge 231 and the first connecting line 10 is recorded as D2, D2 c [2 millimeters, 15 millimeters], for example, 5 millimeters, 8 millimeters, 10 millimeters or 12 millimeters. Similarly, the second connecting line 20 is also a virtual line and is only used to define the forming position of the concave portions 2312, and is not an actual structure.

Specifically, the distance D2 roughly defines the concave-convex degree of the inner edge 231 of the section 230. As long as D2 is larger than 0, the inner edge 231 can be concave and convex, which can reduce the generation of leakage vortex at the tip position of the blade and achieve the noise reduction effect. However, the distance D2 should not be too large, otherwise the concave-convex degree of the inner edge 231 is too large, and the airflow tends to be disordered and the wind loss is large, resulting in the loss of airflow. Therefore, D2∈ [2 millimeters, 15 millimeters] is defined to ensure that the concave-convex degree of the inner edge 231 is appropriate.

In order to verify the technical effect of D2∈ [2 millimeters, 15 millimeters] on the axial flow wind wheel of the present disclosure, on the basis of the above test experiment, when D1 is equal to 6 millimeters, the axial flow wind wheel is further tested based on a rotating speed of 750 r/min, and the test data are as follows:

Table 3-2 shows measured parameters of the axial flow wind wheel of the present disclosure:

| D2/mm | Air volume ($m^3$/h) | Power (W) | Noise (dB) |
|---|---|---|---|
| 2. | 3445 | 133.4 | 52.5 |
| 5. | 3469 | 133.5 | 52.1 |
| 10 | 3481 | 133.7 | 51.9 |
| 15 | 3472 | 133.6 | 52.3 |
| 20 | 3409 | 133.2 | 52.6 |

From the above table 3-2, it can be seen that when distance D2 of the axial flow wind wheel of the present disclosure is kept within the range of 2 millimeters to 15 millimeters at the speed of 750 r/min, the axial flow wind wheel of the present disclosure can greatly reduce the noise value by nearly 1.5 dB to 2.1 dB compared with the conventional axial flow wind wheel under the condition that the air volumes are basically the same. Especially when distance D2 is 5 millimeters to 10 millimeters, the noise effect of the axial flow wind wheel of the present disclosure is most obvious. However, when the distance D2 increases from 15 millimeters to 20 millimeters, the air volume of the axial flow wind wheel decreases rapidly. From this, it can be seen that the value of distance D2 is not as large as possible and should be kept within the range of 2 millimeters to 15 millimeters.

Furthermore, the distance between the second connecting line 20 and the first connecting line 10 may be gradually increased from front to back, that is, the D2 may gradually increase from front to back. In this way, the trail of section 230 can be improved, the air separation point of the trail of section 230 can be effectively prolonged, and the wake airflow noise can be reduced. For example, the D2 may gradually increase from 2 millimeters to 10 millimeters, or increase from 2 millimeters to approximately 12 millimeters, or increase from 4 millimeters to 15 millimeters, along the front-back direction.

Please referring to FIGS. 5 and 6 again, according to the above embodiments, the distance between any one of the convex portions 2311 and a previous adjacent convex portion 2311 is recorded as S1, and the distance between the convex portion 2311 and a subsequent adjacent convex portion 2311 is recorded as $S_2$, $S_2$∈ [1.2S1, 1.5S1], so as to gradually increase the amplitude of fluctuation of the inner edge 231 along the front-back direction, and improve the trail of the section 230, therefore, the wake airflow noise is effectively reduced, and better noise reduction effect is achieved.

Specifically, S1 and S2 roughly define the amplitude of the fluctuation of the inner edge 231 along the front-back direction. The difference between S1 and S2 is not suitable to be too large, and S2 should be kept within the range of 1.251 to 1.5S1. For example, when S1 is 5 millimeters, S2 has a range of 6 millimeters to 7.5 millimeters. Alternatively, when S1 is 7 millimeters, S2 has a range of 8.4 millimeters to 10.5 millimeters. Or, when S1 is 10 millimeters, S2 has a range of 12 millimeters to 15 millimeters.

Referring to FIG. 6, according to any of the above embodiments, in order to ensure that the tip position of the blade 200 is not prone to form the leakage vortex, and to enhance the flow guiding effect of the blade 200, the section 230 is provided with a guide groove (not shown) extending from the front leaf margin 2*a* to the rear leaf margin 2*b*, and the guide groove has a width of 0.5 millimeters to 3 millimeters.

Here, the guide groove has a width of 0.5 millimeters to 3 millimeters, the guide groove is a micro guide groove. When the airflow flows through the tip position of the blade 200, part of the airflow flows backward along the guide groove, so that on the one hand, the guide force of the blades 200 can be improved, and on the other hand, the formation of the leakage vortex on the top position can be reduced to achieve the noise reduction effect.

The present disclosure also provides an air conditioner. The air conditioner includes an axial flow wind wheel, and the specific structure of the axial flow wind wheel can be referred to the above embodiments. As the air conditioner adopts all the technical solutions of the above exemplary embodiments, the air conditioner at least has all of the beneficial effects of the technical solutions of the above exemplary embodiments, no need to repeat again.

The foregoing description merely portrays some illustrative embodiments according to the disclosure and therefore is not intended to limit the patentable scope of the disclosure. Any equivalent structural or flow transformations that are made taking advantage of the specification and accompanying drawings of the disclosure and any direct or indirect applications thereof in other related technical fields shall all fall in the scope of protection of the disclosure.

What is claimed is:

1. An axial flow wind wheel, comprising:

a wheel hub; and a plurality of blades, arranged on the wheel hub at intervals, each blade in the plurality of blades comprising:

a front leaf margin, a rear leaf margin, and a top leaf margin connecting to outer edges of the front leaf margin and the rear leaf margin, a tip position of each blade in the plurality of blades defining a section inclined from a pressure surface of the blade to a suction surface of the blade, and extended from the front leaf margin to the rear leaf margin, the section comprising an external edge defined at the top leaf margin, and an inner edge defined at the pressure surface, and the inner edge being defined to be concave and convex inwards and outwards, and wherein a region between the inner edge and the external edge is planar.

2. The axial flow wind wheel according to claim 1, wherein, the inner edge comprises convex portions protruding outwards, and a distance between a first connecting line connecting the top ends of each convex portion of the inner edge and the external edge is recorded as D1, D1∈ [1 millimeter, 10 millimeters]; and, a concave portion concaving inwards is defined between any two adjacent convex portions, and a distance between a second connecting line connecting the bottom ends of each concave portion of the inner edge and the first connecting line is recorded as D2, D2∈[2 millimeters, 15 millimeters].

3. The axial flow wind wheel according to claim 2, wherein, D2∈ [5 millimeters, 10 millimeters].

4. The axial flow wind wheel according to claim 2, wherein, the distance between the first connecting line and the external edge gradually increases from front to back.

5. The axial flow wind wheel according to claim 3, wherein, the distance between the second connecting line and the first connecting line gradually increases from front to back.

6. The axial flow wind wheel according to claim 4, wherein, the distance between any one of the convex portions and a previous adjacent convex portion is recorded as S1, and the distance between the any one of the convex portions and a subsequent adjacent convex portion is recorded as S2, S2∈ [1.2S1, 1.5S1].

7. The axial flow wind wheel according to claim 1, wherein, a tangential angle formed between the section and an extending surface of the pressure surface is recorded as α, α∈[10 degrees, 20 degrees].

8. The axial flow wind wheel according to claim 7, wherein, a is configured to gradually increase from the front leaf margin to the back leaf margin.

9. The axial flow wind wheel according to claim 1, wherein, the inner edge is defined with a jagged shape or a corrugated shape.

10. An air conditioner, wherein, the air conditioner comprises an axial flow wind wheel, the axial flow wind wheel comprises:

a wheel hub; and a plurality of blades, arranged on the wheel hub at intervals, each blade in the plurality of blades comprises a front leaf margin, a rear leaf margin, and a top leaf margin connecting to outer edges of the front leaf margin and the rear leaf margin, a tip position of each blade in the plurality of blades defines a section inclined from a pressure surface of the blade to a suction surface of the blade, and extended from the front leaf margin to the rear leaf margin, the section comprises an external edge defined at the top leaf margin, and an inner edge defined at the pressure surface, and the inner edge is defined to be concave and convex inwards and outwards, and wherein a region between the inner edge and the external edge is planar.

11. The air conditioner according to claim 10, wherein, the inner edge comprises convex portions protruding outwards, and a distance between a first connecting line connecting the top ends of each convex portion of the inner edge and the external edge is recorded as D1, D1∈ [1 millimeter, 10 millimeters]; and, a concave portion concaving inwards is defined between any two adjacent convex portions, and a distance between a second connecting line connecting the bottom ends of each concave portion of the inner edge and the first connecting line is recorded as D2, D2∈[2 millimeters, 15 millimeters].

12. The air conditioner according to claim 11, wherein, D2∈ [5 millimeters, 10 millimeters].

13. The air conditioner according to claim 11, wherein, the distance between the first connecting line and the external edge gradually increases from front to back.

14. The air conditioner according to claim 11, wherein, the distance between the second connecting line and the first connecting line gradually increases from front to back.

15. The air conditioner according to claim 14, wherein, the distance between any one of the convex portions and a previous adjacent convex portion is recorded as S1, and the distance between the any one of the convex portions and a subsequent adjacent convex portion is recorded as S2, S2∈ [1.2S1, 1.5S1].

16. The air conditioner according to claim 10, wherein, a tangential angle formed between the section and an extending surface of the pressure surface is recorded as $\alpha$, $\alpha \in$[10 degrees, 20 degrees].

17. The air conditioner according to claim 16, wherein, $\alpha$ is configured to gradually increase from the front leaf margin to the back leaf margin.

18. The air conditioner according to claim 10, wherein, the inner edge is defined with a jagged shape or a corrugated shape.

* * * * *